United States Patent [19]

Nava

[11] 4,397,047

[45] Aug. 9, 1983

[54] DEVICE FOR THE CONTROLLED LIFTING OF HELMET VISORS AND THE LIKE

[76] Inventor: Pier L. Nava, Verderio Superiore (Como), Italy

[21] Appl. No.: 281,696

[22] Filed: Jul. 8, 1981

[30] Foreign Application Priority Data

Jul. 11, 1980 [IT] Italy ..... 23410 A/80

[51] Int. Cl.[3] ..... A42B 3/02; A61F 9/00

[52] U.S. Cl. ..... 2/424; 2/10

[58] Field of Search ..... 2/424, 10, 6, 8, 9

[56] References Cited

U.S. PATENT DOCUMENTS 4,223,410 9/1980 Nava .
4,242,757 1/1981 Nava ..... 2/10
4,247,960 2/1981 Nava ..... 2/10 X
4,297,747 11/1981 Nava ..... 2/10 X

*Primary Examiner*—Peter P. Nerbun
*Attorney, Agent, or Firm*—Stevens, Davis, Miller & Mosher

[57] ABSTRACT

The device (FIG. 1) is provided in combination with helmet A and related vizor B, with a box shaped gear and pinion assembly 10, secured by pin 12 to helmet A. A gear wheel 14, secured to side wall A of the helmet, engages, via pinion 20 held by gear and pinion assembly 10, with a sector gear (rack) 24 also secured to said gear and pinion assembly which is torsionally connected to the end of vizor B. When assembly 10 is caused to oscillate in the clockwise direction to lift vizor B, a complementary counter-clockwise oscillation is imparted to same to permit complete lifting of the vizor, so that its top edge may approach and fit tightly over the surface of helmet A.

9 Claims, 4 Drawing Figures

DEVICE FOR THE CONTROLLED LIFTING OF HELMET VISORS AND THE LIKE

DESCRIPTION

This invention relates to a device for the controlled actuation (lifting) of the visors in helmets and similar headgear.

The helmets used in sports are provided with in-built visors, the edges of which must not project from the surface of the helmet. It ensues that, in order to remove the visor from the helmet, certain steps must be performed to disengage first the visor from the ledge in the helmet and bring it to the lifted position, whilst limiting its encumbrance.

The purpose of the invention is to provide a device applicable to helmets with in-built visors and apt to shift said visor to the required up-lifted position with simple and reliable operations which may be performed by the user with one hand, as in the case of motorcyclists.

A further object of the invention is to provide a device reliable in operation, of limited encumbrance, which may be fitted into a ledge between the helmet and the visor and apt to free the helmet aperture almost totally.

The device according to the invention is characterized in that it is provided with a pair of gear and pinion assemblies securing the visor pivotably to the helmet and with actuating means in at least one of the elements of the pair of gear and pinion assemblies, operatively secured to the visor and helmet, to impart to the former (visor) a complementary oscillation during its upward lift to thus bring it closer to the helmet surface.

According to one advantageous form of embodiment of the device, the kinematic train that operatively connects to each other the pivots of the gear and pinion assembly, is at least in part equipped with wheel mechanisms apt to impart to the visor an oscillation contrary to that of said gear and pinion assembly.

The invention will now be explained in the following description, taken in conjunction with the accompanying drawings which illustrate, only by way of example, one advantageous embodiment of the device as applied to motorcyclists' helmets.

Figure 1:
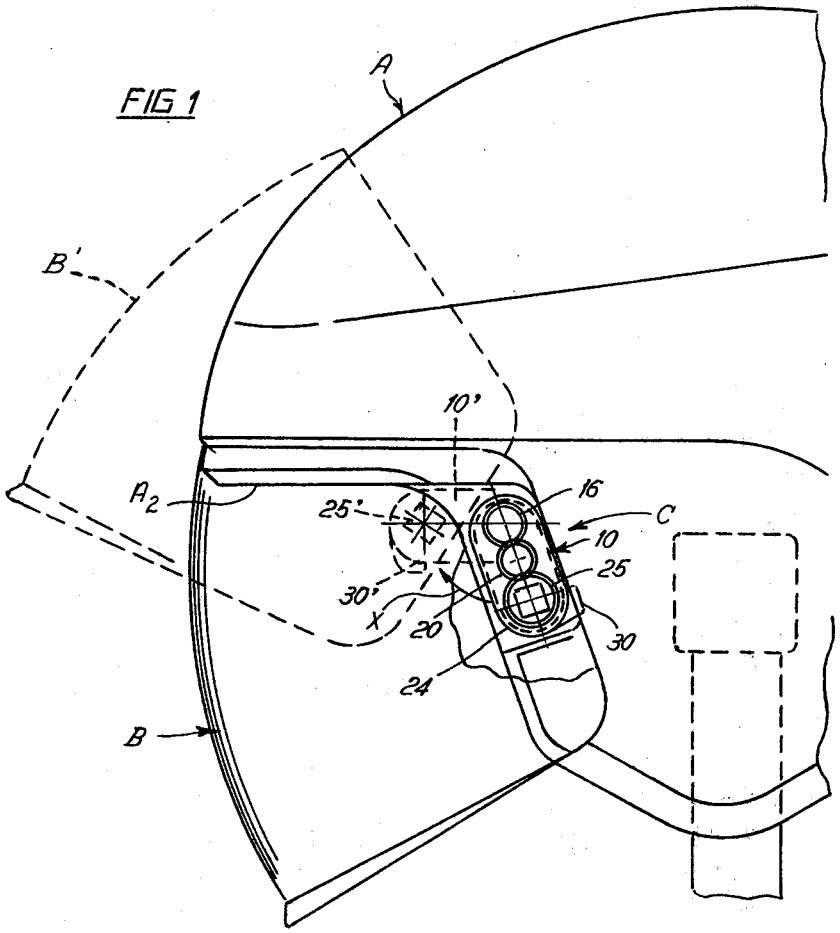
FIG. 1 is a side view of the helmet fitted with the visor, with some parts removed.

In the drawings, letter A indentifies the helmet and letter B the relevant visor; letter C identifies the device according to the invention. In the drawings only one of the devices is considered, which however are actually two fitted in two ledges $A_1$, in the extremities of the opposite side walls of the helmet.

Device C is provided with a gear and pinion assembly 10, which, in the case illustrated, is box shaped and holds securely at one of its ends a pin 12, pivotably engaged in the hole of a bush 14, suitably secured to the wall of ledge $A_1$ of the helmet. One of the ends of bush 14 is provided with a flange 16 provided with gear teeth 18 in engagement with the teeth of a pinion 20, rotatably secured by a pin 22, attached to the bottom wall of gear pinion assembly 10.

The teeth of pinion gear 20 also come into engagement with the teeth in a part of the edge of disc 24 forming a gear rack provided with a polygonal hub 25 (quadrilateral in the case shown) and which is surrounded on one of its faces, by a guide way in which crown 26 of assembly 10 engages.

Polygonal hub 25 projects a suitable distance from assembly 10 to engage, torsionally and through the relevant hole, with one of the ends of visor B. These two parts are secured to each other by a button 28 engaging with the hole of hub 25.

Figure 4:
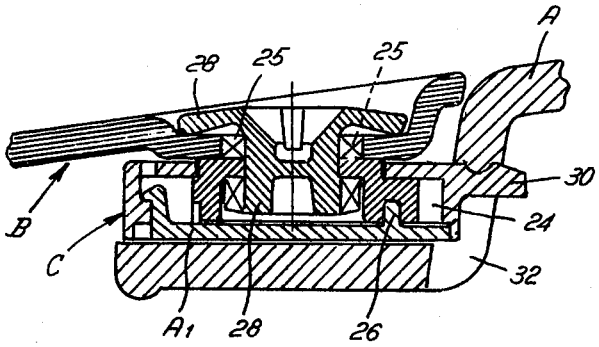
FIG. 4 is a transversal section.
Figure 3:
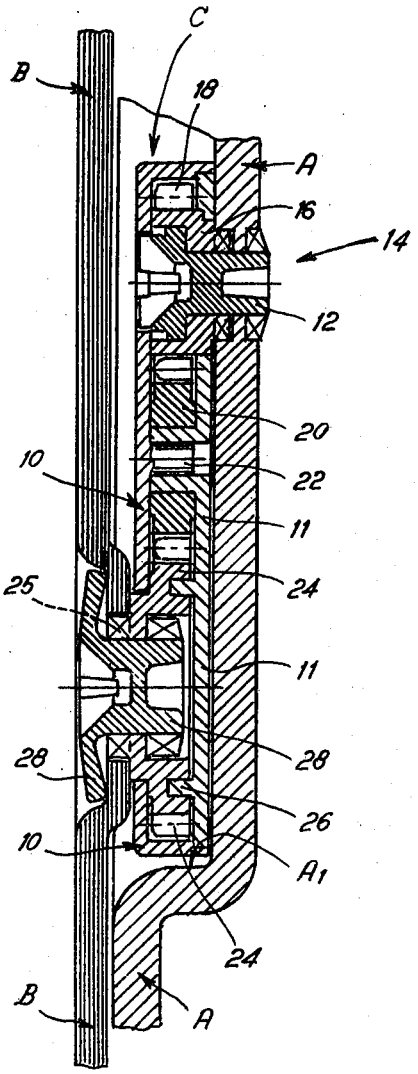
FIG. 3 is a longitudinal section of FIG. 2.

Device C, as shown in FIGS. 3 and 4, is housed and secured in the casing formed by assembly 10, of suitable length, limited thickness and apt to be housed in ledge $A_1$ of helmet A and be covered by the corresponding end of visor B, the back of which is in turn housed in periphral ledge $A_2$ adjacent to the aperture of said helmet A.

Assembly 10 is provided, on its rear lower part, with a shaped lug 30 engaging forcibly in slot 32 in the side wall which delimits ledge $A_1$. The lug sets and holds visor B in its closed position.

Figure 2:
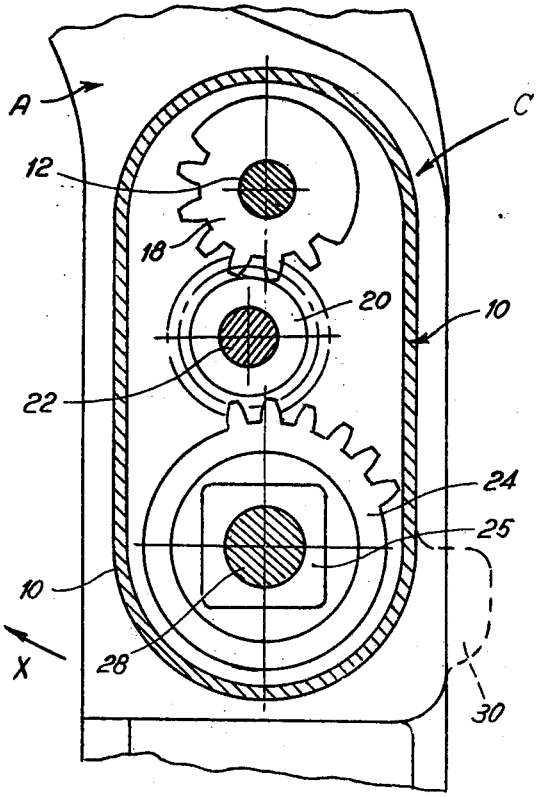
FIG. 2 shows the device of FIG. 1 drawn on a larger scale, with some parts removed.

To lower and lift visor B, the user can act either on the bottom edge of said visor or on the two buttons 28 which secure the visor to device C, shift it in the direction of arrow X and thus cause the two assemblies 10 to oscillate in a clockwise direction (FIGS. 1 and 2) around pin 12. It ensues that visor B, by moving in the direction of arrow X disengages from ledge $A_2$ of helmet A, while oscillation of assemblies 10 around pins 12 causes pinions 20 to roll along the fixed teeth in flanges 18.

It follows the visor B is animated by two oscillating motions simultaneously, the first clockwise (due to the oscillation of assembly 10 around pin 12) and the second counter clockwise, due to the kinematic train (18-20-24) extending between pins 12 and 25. The resultant of these two components ensures a controlled movement to visor B which, starting from FIG. 1 (in which visor B is indicated by a continuous line), reaches position B', indicated by the dotted line in the same FIG. 1. In its uplifted position, as shown, the visor leaves the aperture of the helmet A completely free and also takes on the least cumbersome position, such that its top part is adherent to the outer surface of said helmet A.

It is obvious that modifications and variants may be introduced in the device described and illustrated; for example the kinematic train in assembly 10 connecting operatively pins 12 and 25, may be fitted with elements equivalent to wheel systems 18-20-24, such as cams or similar devices, operatively connected to each other by partly flexible linkages etc.

This, in order to impart to visor B, during its upward lift, a complementary oscillating motion intended to bring the top edge of the visor close to the surface of the helmet; hence in a stable and safe position as it is held in place by the wind thrust of the vehicle in motion.

If required, device C may be provided with braking means and locking means to hold visor B at any intermediate point between the two limit positions.

It is understood that the present protection also extends to helmets of any known type, with visors operable by the device according to the invention.

In practice, the details of embodiment of the device may vary, depending on application requirements of the helmet considered, but without departing from or affecting the scope of the following claims:

I claim:

1. Device to effect controlled lifting of the visors of helmets and similar headgear, in particular in-built visors, comprising a pair of gear and pinion assemblies to connect movably the ends of a visor to a helmet and actuating means in at least one of the elements of the pair of gear and pinions assemblies, operatively securable to the helmet and visor, to impart to the visor a complementary oscillation during its lifting in order to set it closer to the helmet outer surface.

2. Device according to claim 1, wherein said gear and pinion assembly includes pins connected to each other by the kinematic train in said gear and pinion assembly, said assembly consisting at least in part of rotating elements relating to said asssembly, so that any angular movement imparted to the gear and pinion assembly in a given direction will correspond to an equivalent shifting of the visor.

3. Device according to claim 1 or claim 2 wherein said gear and pinion assembly is at least in part box-shaped to house at least a part of the kinematic train relevant to said pins.

4. Device according to claim 2, wherein one of said pins of said gear and pinion assembly is secured to one end of said assembly and engages rotatably in a bushing securable to the wall of said helmet, said bushing being provided with a flange forming the first element of the kinematic train which houses said pins of said gear and pinion assembly.

5. Device according to claim 1 or claim 2, wherein said gear and pinion assembly is provided, on its other end, with a disc constituting the last element in the kinematic train which connects pins of the gear and pinion assembly to each other and which disc is provided with a polygonal hub securable torsionally to a visor.

6. Device according to claim 2, wherein said kinematic train connecting to each other pins of said gear and pinion assembly consists of gear sectors, the first and last of which are firmly holdable by the helmet and visor, respectively.

7. Device according to claim 2, wherein said gear and pinion assembly is provided, adjacent to its movable end, with a shaped lug which forms a grip for the user.

8. Helmet, in particular sports helmet, fitted with the actuating device according to claim 1 or claim 2.

9. Helmet according to claim 8, having ledges on the walls which hingedly support said visor to house the two lifting devices for the visor.

* * * * *